US006701552B2

(12) United States Patent
Suzuki et al.

(10) Patent No.: US 6,701,552 B2
(45) Date of Patent: Mar. 9, 2004

(54) WARM-AIR BLOWER FOR USE WITH AIR-CONTROLLED BEDDING

(76) Inventors: Hiroko Suzuki, 11-32, Toneyama 6-chome, Toyonaka-shi, Osaka (JP); Yoshio Suzuki, 11-32, Toneyama 6-chome, Toyonaka-shi, Osaka (JP); Emi Suzuki, 11-32, Toneyama 6-chome, Toyonaka-shi, Osaka (JP); Ryutaro Kamiya, 11-32, Toneyama 6-chome, Toyonaka-shi, Osaka (JP)

( * ) Notice: Subject to any disclaimer, the term of this patent is extended or adjusted under 35 U.S.C. 154(b) by 62 days.

(21) Appl. No.: 09/976,695

(22) Filed: Oct. 12, 2001

(65) Prior Publication Data

US 2003/0070235 A1 Apr. 17, 2003

(51) Int. Cl.[7] ..... A61F 7/00
(52) U.S. Cl. ..... 5/421; 5/423; 607/107
(58) Field of Search ..... 5/421, 423; 607/104, 607/107; 219/212; 62/259.3

(56) References Cited

U.S. PATENT DOCUMENTS 4,777,802 A * 10/1988 Feher ..... 62/3.3
5,044,364 A * 9/1991 Crowther ..... 607/107
5,300,098 A * 4/1994 Philipot ..... 607/96
5,730,120 A * 3/1998 Yonkers, Jr. ..... 128/202.13

FOREIGN PATENT DOCUMENTS

JP H7-171037 7/1995
JP H9-154669 6/1997

* cited by examiner

*Primary Examiner*—Michael F. Trettel
(74) *Attorney, Agent, or Firm*—Koda & Androlia

(57) ABSTRACT

A warm-air blower comprised of two air outlets and an air intake which is provided on either the left-hand side or right-hand side of an air blower unit. The air taken into the interior of the air blower unit through the intake flows through the interior of the air blower unit by a fan which is provided at a location relatively far away from the air intake. The fan blows the air through a heater chamber and further blows the heated air out of the blower unit through the air outlets that are arranged one above the other to an air-controlled bedding. One or both of the air outlets are equipped with a shutter.

3 Claims, 4 Drawing Sheets

WARM-AIR BLOWER FOR USE WITH AIR-CONTROLLED BEDDING

BACKGROUND OF THE INVENTION

1. Field of the Invention

The inventors have invented a concept for air-controlled bedding that creates an ideal sleeping environment with appropriate temperature and humidity levels by blowing warm air or cool air into the bedding. The present invention relates to a warm-air blower for use in such air-controlled bedding.

2. Prior Art

As disclosed in Japanese Patent No. 2616857 (Japanese Patent Application Laid-Open No. H7-171037) and Japanese Patent Application Laid-Open No. H9-154669 (1997), the inventors have developed a concept for controlling the temperature and humidity of the sleeping environment to an appropriate level by blowing warm air or cool air between the quilt and the futon or air-controlled mat. However, a warm-air blower for achieving such a concept tends to be noisy and can cause the sleeper to feel thirsty.

SUMMARY OF THE INVENTION

The object of the present invention is to realize a warm-air blower for use with air-controlled bedding that operates more quietly and solves the problem of warm air causing thirst, thereby realizing a more comfortable sleeping environment.

In order to achieve the above objective, the air blower unit 1 has an air intake 2 near the left- or right-hand side of its front surface and optionally another air intake 2 at a corresponding position on its rear surface, and the air taken in from these air intakes 2, 2 is led through the interior of the air blower unit 1 to a fan 3 which is positioned at a distance from said air intake(s) 2, or more specifically, at the opposite end of the air blower unit from the air intake(s), and then blown out of the air blower from air outlets 5, 6 after passing through a heater chamber 4 within an air-blow duct 15.

The air outlets 5, 6 are arranged one above the other, of which the upper outlet, i.e., air outlet 5 supplies warm air to the quilt 16 from the foot side. The lower outlet, i.e., air outlet 6, supplies warm air to the futon, which is air controlled, or to the air-controlled mat 18 from the foot side. One of the air outlets 5, 6 is equipped with a shutter 7 or 8. Optionally, both of the air outlets 5, 6 are equipped with shutters 7, 8. By providing these shutters 7, 8, it becomes possible to change the ratio of the volume of warm air supplied to the quilt and the volume of warm air supplied to the futon or air-controlled mat 18 to achieve an even more comfortable sleeping environment.

When using the warm-air blower of the present invention with a futon in a Japanese-style room, the air blower unit 1 can be simply placed near the foot side of the futon. When using it with a bed, however, it is safer to fix the blower unit onto the foot side of the bed frame 9 to prevent the possibility of the air blower unit 1 falling off the bed. For use with a care bed or a hospital bed with a mechanism for raising the bed surface, a mount 10 is established in such a way as to extend the foot side of the bed-raising mechanism 11, and the air blower unit 1 is fixed to said mount 10. In this way, the air blower unit 1 moves in accordance with the elevation of the bed, so the air outlets 5, 6 of the air blower unit 1 do not become disconnected from airways 17, 19 of the quilt and futon.

DETAILED DESCRIPTION OF THE INVENTION

Embodiments of the warm-air blower for use with air-controlled bedding according to the present invention will now be explained by reference to the accompanying drawings.

Figure 1:
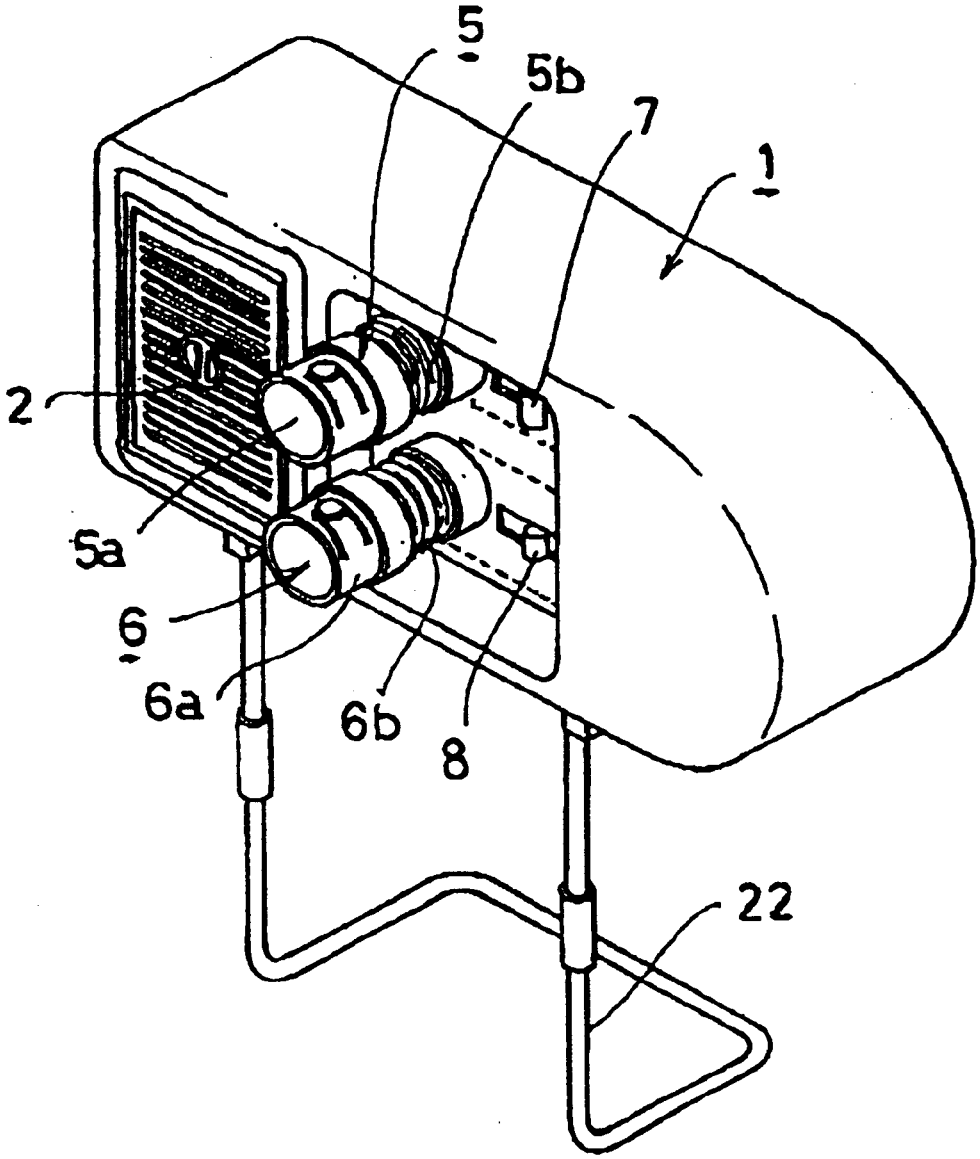
FIG. 1 is a perspective view of the warm-air blower for use with air-controlled bedding of the present invention.
Figure 2:
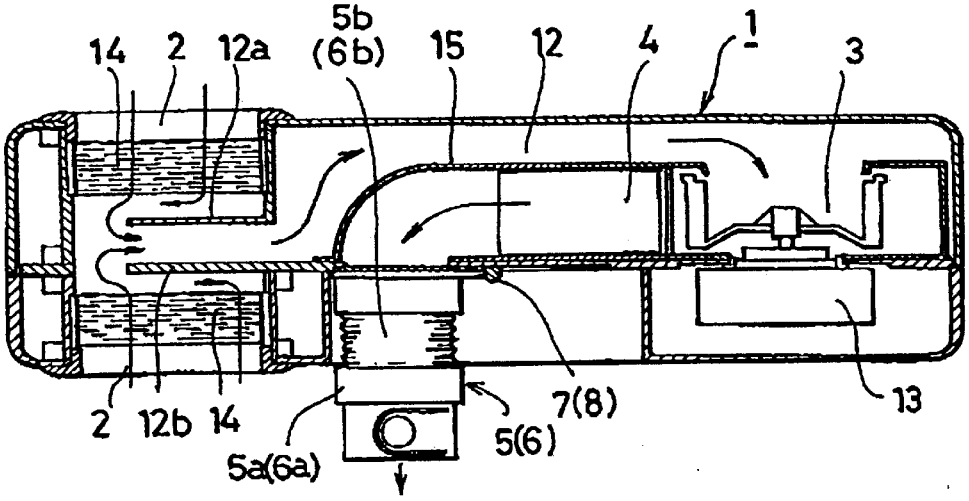
FIG. 2 is a front cross sectional view of the warm-air blower for use with air-controlled bedding of the present invention.

FIG. 1 is a perspective view of a warm-air blower of the present invention and FIG. 2 is a cross sectional view of the same.

The warm-air blower shown in FIGS. 1 and 2 comprises a horizontally long air blower unit 1, air intakes 2, 2 at one side of the unit, i.e., the left-hand side in the drawings, on the front and rear surfaces, and a fan 3 inside the air blower unit 1 at the other side from the air intakes 2, 2, i.e., the right-hand side in the drawings. The fan 3, driven by a motor 13, takes in fresh air from either of the air intakes 2, 2. The air taken in is then filtered by a filter 14 and supplied to the fan 3 through a suction duct 12. The air drawn through the fan 3 runs through the heater chamber 4 inside the air-blow duct 15 and, after being heated, is blown out of the unit as warm air from air outlets positioned approximately in the middle of the air blower unit 1.

The embodiment shown in the drawings has air intakes on the front and rear surfaces of the air blower unit. Therefore, even if one of the air intakes is blocked, for example by the quilt or futon, the air blower can continue delivering air without any problem.

The two air outlets 5, 6, which are arranged one above the other approximately in the middle of the air blower unit 1, are equipped with shutters 7, 8 for regulating the airflow of each air outlet. While it is possible to equip both air outlets with shutters, it is also possible to equip only the upper outlet, i.e., air outlet 5, with a shutter. As shown in FIGS. 1 and 2, connection tubes 5*a*, 6*a* for connecting the air outlets 5, 6 to the airways of the quilt and futon are connected to the air outlets 5, 6 via bellows-shaped flexible pipes 5*b*, 6*b*, which are connected to the bases of said connection tubes 5*a*, 6*a*, in such a way as to comply with the movement of the quilt and futon.

The noise source of the warm-air blower is the fan 3, which is driven by the motor 13. The sound of the fan 3 that is generated inside the air blower unit 1 is transmitted to the outside of the unit via the air intakes 2, 2 and is discernible as noise. In this invention, the air intakes 2, 2 are arranged either on the left-hand side or right-hand side of the air blower unit 1, at a distance from the fan 3. Therefore, the sound generated by the fan 3 travels to the air intakes 2, 2 via the suction duct 12 inside the air blower unit 1, flowing to the other end of the air blower unit 1. As the sound of the fan 3 travels through the suction duct 12, it is attenuated on the way so that only a low level of noise leaks out of the unit. In the embodiment shown in the drawings, in particular, the suction duct 12 itself is curved, and detour walls 12*a*, 12*b* are formed between the air intakes 2, 2 and the suction duct 12, effectively reducing the volume of the fan noise that leaks out of the unit.

The detour walls 12*a*, 12*b* are arranged in the direction that extends the suction duct 12 in such a way as to partially overlap the air intakes 2, 2 in parallel. This arrangement increases the silencer effect because the sound that has been transmitted through the suction duct 12 does not leak directly from the air intakes 2, 2. As a result, the sleeper is less disturbed by the operation of the air blower. The filters 14 provided for the air intakes 2, 2 are also effective as sound-absorbing materials. The air taken in from the air intakes 2, 2 flows into the suction duct via the detour walls as shown by the arrows in FIG. 2.

Figure 3:
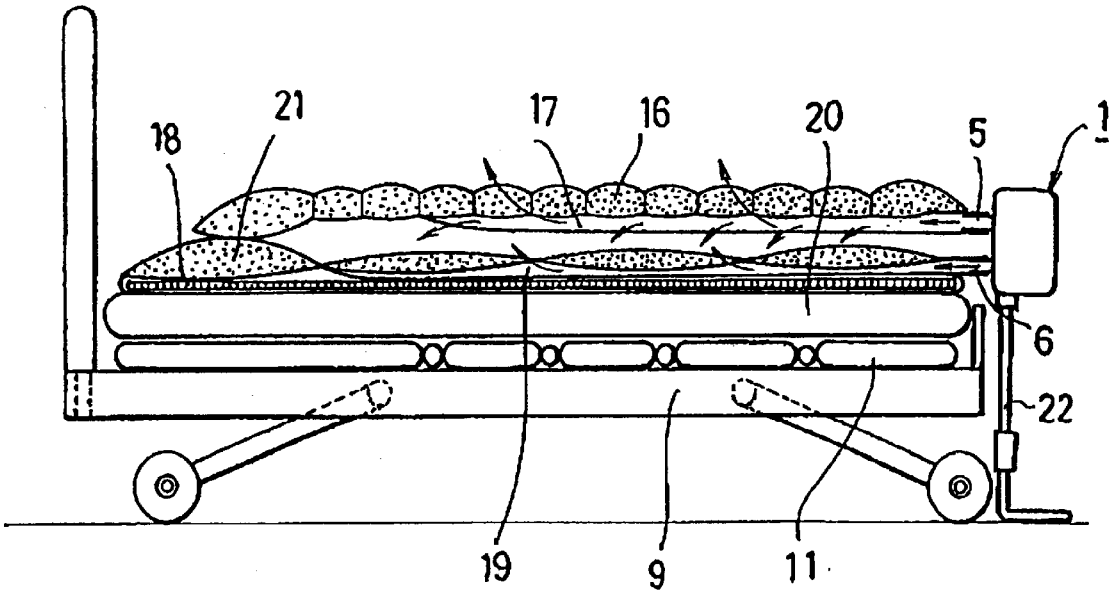
FIG. 3 is a side view illustrating a condition in which the warm-air blower is placed next to the foot side of the bed for use with air-controlled bedding.
Figure 4:
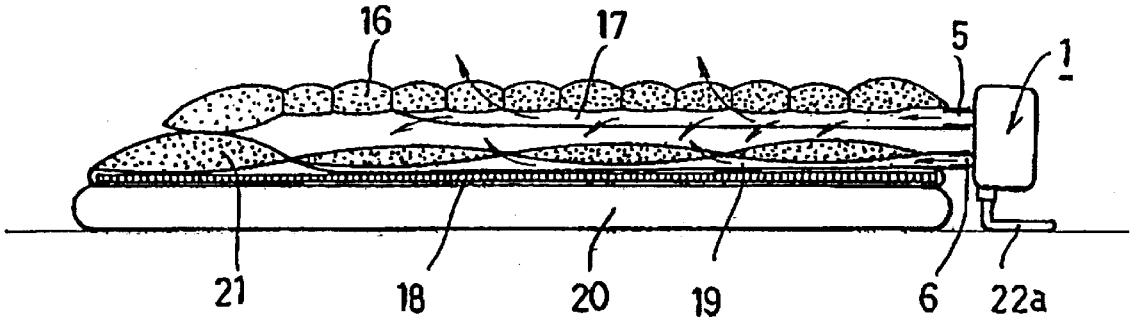
FIG. 4 is a side view illustrating a condition in which the warm-air blower is placed on the foot side of air-controlled bedding that is spread on the floor.
Figure 5:
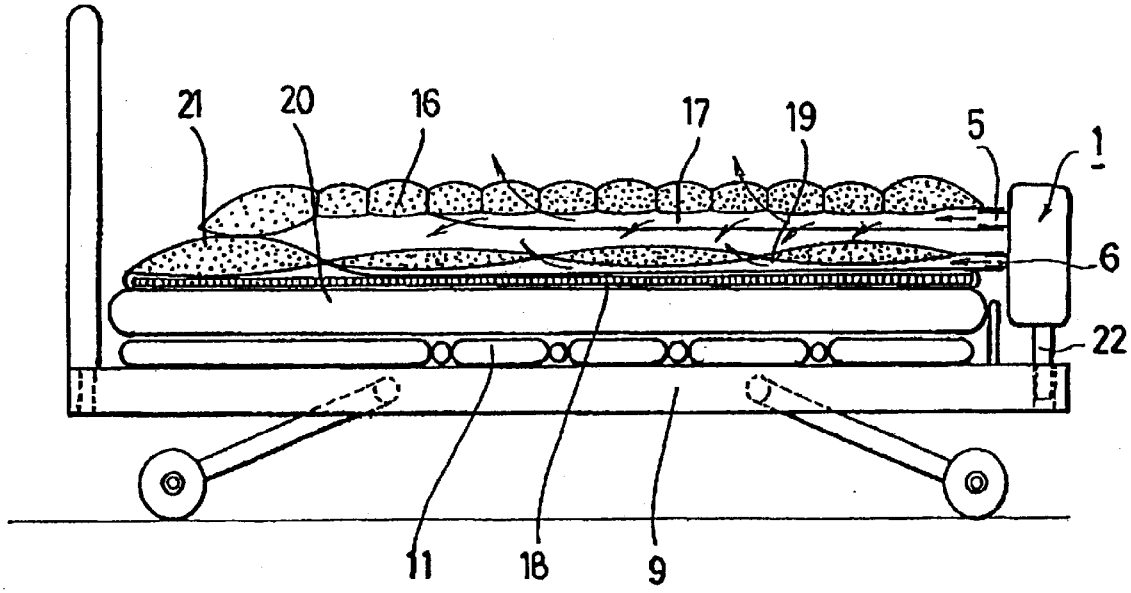
FIG. 5 is a side view illustrating a condition in which the warm-air blower is fixed to the foot side of the bed frame for use with air-controlled bedding.

FIG. 3 shows an example in which the warm-air blower is used. In this application, warm air blown out of the upper outlet of the air blower unit 1, i.e., the air outlet 5, is supplied to the airway 17 of the air-controlled quilt, and warm air blown out of the lower outlet, i.e., the air outlet 6, is supplied to the airway 18 of the air-controlled mat 18 spread on the mattress 20. A feather futon 21 is spread on the air-controlled mat 18. In this way, the sleeping place is maintained at an optimum temperature and humidity for creating a comfortable sleeping environment.

In an experiment conducted by the inventors, it was found that providing an abundant supply of warm air to the quilt causes the sleeper to feel thirsty. It was also found that it is preferable to supply more warm air to the futon or air-controlled mat in order to create a more comfortable sleeping environment. Supplying an adequately large amount of warm air to the air-controlled futon or air-controlled mat 18 is also effective in preventing bedsores for sick or old people who remain bedridden over an extended period of time. To take advantage of this effect, the inventors have designed the unit to allow one or both of the air outlets 5, 6 to be equipped with a shutter 7 or shutters 7, 8 that can regulate the airflow. The ratio of warm air supplied from the upper air outlet 5 and that from the lower air outlet 6 can be adjusted to suit the user's preference by opening or closing the shutter(s) 7, 8.

Both the upper and lower air outlets 5, 6 can be equipped with shutters to regulate the airflow, but it is also possible to achieve the same objective by equipping only the upper air outlet 5 with a shutter and adjusting the warm-air supply ratio by opening and closing this shutter. As mentioned above, it is preferable to supply more warm air to the futon or air-controlled mat rather than to the quilt. Therefore, if only one of the air outlets is to be equipped with a shutter, it is preferable to equip the upper air outlet 5 with a shutter. Although it is desirable to supply warm air to both the quilt and the futon, in some types of air-controlled bedding, only the quilt or the futon is air controlled. For use with such air-controlled bedding, the warm-air blower of the present invention can be used with one of the shutters closed. The target temperature and humidity of the sleeping environment can be achieved by controlling the temperature of the warm air itself and the airflow.

The warm-air blower of the present invention can be conveniently equipped with a detachable or extendable leg 22 as shown in FIG. 1. By equipping the warm-air blower with such a leg, it is possible to stand the warm-air blower next to the foot side of the bed, as shown in FIG. 3, and adjust its height to match the height of the air-controlled bedding. When using the air-controlled bedding in a Japanese-style room, the air blower unit 1 can be equipped with a short leg 22*a* or placed directly on a tatami mat.

When using air-controlled bedding on a bed at a hospital, for example, placing the air blower unit 1 next to the foot side of the bed may create an obstacle for nursing staff and there is a danger that the unit may be knocked down. To avoid such inconveniences, the air blower unit 1 can be fixed to the bed frame 9. In order to fix the air blower unit 1 to the bed frame, a leg 22 that extends directly from the air blower unit 1 is detachably inserted into a mounting hole established on the bed frame 9 and fixed in place. It is also possible to use other means of engagement such as screws to fix the air blower unit to the bed frame.

Figure 6:
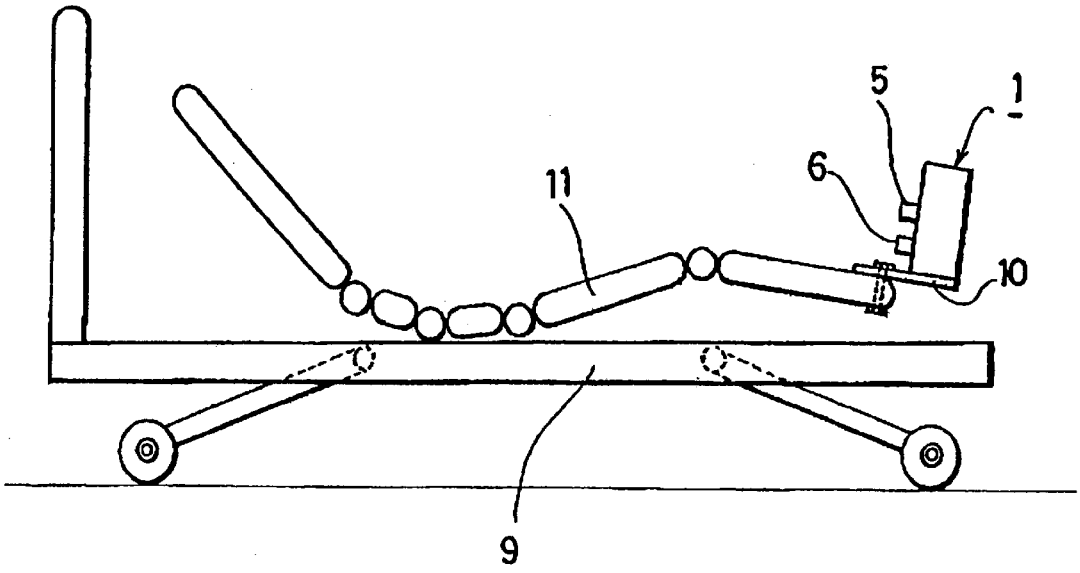
FIG. 6 is a side view showing a condition in which the warm-air blower is fixed to a bed-raising mechanism of a raisable bed.

Many of the beds used at hospitals or for nursing care are equipped with a bed-raising mechanism 11 under the mat 20, as shown in FIG. 6, to assist the patient (or sleeper) in maintaining a comfortable posture. This type of bed allows the sleeper to sleep in a variety of postures, for example, not just raising the upper body but with the legs folded.

When using air-controlled bedding with a bed-raising mechanism, there is a possibility of the air outlets 5, 6 of the air blower unit 1 becoming disconnected from the airways 17, 19 of the air-controlled bedding because the foot sides of the quilt and futon move. In order to avoid this possibility and to ensure safe use of the air-controlled bedding, the inventors have devised a mechanism comprising a mount 10 that is established in such a way as to extend the foot side of the bed-raising mechanism 11, which can move vertically and horizontally, so that the air blower unit 1 is fixed to the mount 10. In this way, the distance between the air-controlled bedding and the air blower unit can be kept constant in the interest of safety even if the bed is raised.

The warm-air blower for use air-controlled bedding of the present invention described in claim 1 arranges a fan inside the air blower unit at a position relatively distant from the air intake(s). This reduces the level of noise leaking outside the air blower unit and allows the sleeper to sleep soundly without being disturbed by the unit's operating noise.

According to the invention described in claim 1, warm air is supplied from two air outlets arranged one above the other, making it possible to use the quilt and the futon of air-controlled bedding at the same time. The two vertically arranged air outlets are also equipped with shutters so that it is possible to adjust the airflow from the upper and lower outlets to a desired ratio, thereby creating a more comfortable sleeping environment. By closing the shutter of one of the air outlets, the quilt or the futon can be used independently as air-controlled bedding.

According to the invention described in claim 2, the air blower can be fixed to the bed frame as necessary. This makes it possible to use the warm-air blower without worrying about the air blower unit falling off the bed. When fixed in this way, the air blower unit does not create an obstacle as in the case when it is placed adjacent the bed. This makes it possible to use air-controlled bedding in a limited space such as in a hospital ward.

According to the invention described in claim 3, when using air-controlled bedding with a raisable bed that allows the user to sleep with the upper body raised or the legs folded, the air blower unit of the warm-air blower can always be maintained at a position adjacent the foot side of the bedding. Therefore, even if the bed is raised, the air outlets of the air blower unit do not become disconnected from the airways of the air-controlled bedding or mat, so the user can sleep in peace.

What is claimed is:

1. A warm-air blower for use with air-controlled bedding comprising a quilt and a futon, which is used to control the sleeping environment by supplying warm air or cool air to the bedding, wherein the warm air blower unit has an air intake near a left- or right-hand side of its front surface, the air taken in from said air intake is led so as to flow through the interior of the warm air blower unit to a fan, said fan is positioned at a distance from said air intake, the warm air passing through the heater chamber is blown out of the warm air blower unit through two vertically arranged air outlets, and one or both of said outlets are equipped with a shutter that is capable of regulating the airflow.

2. The warm-air blower for use with air-controlled bedding according to claim 1, wherein the air blower unit can be detachably mounted to a foot side of a bed frame.

3. The warm-air blower for use with air-controlled bedding according to claim 1, wherein a mount is established in such a way as to extend the foot side of a bed-raising mechanism that can move the bed vertically and horizontally, and the air-blower unit is fixed to said mount.

* * * * *